US010487841B2

(12) United States Patent
Bae et al.

(10) Patent No.: US 10,487,841 B2
(45) Date of Patent: Nov. 26, 2019

(54) COMPRESSOR CONTROL SYSTEM AND METHOD

(71) Applicant: HANWHA AEROSPACE CO., LTD, Changwon-si (KR)

(72) Inventors: In Hwan Bae, Changwon-si (KR); Joo Sang Eom, Changwon-si (KR)

(73) Assignee: HANWHA AEROSPACE CO., LTD., Changwon-si (KR)

( * ) Notice: Subject to any disclaimer, the term of this patent is extended or adjusted under 35 U.S.C. 154(b) by 222 days.

(21) Appl. No.: 15/643,950

(22) Filed: Jul. 7, 2017

(65) Prior Publication Data

US 2018/0010611 A1 Jan. 11, 2018

(30) Foreign Application Priority Data

Jul. 7, 2016 (KR) ..... 10-2016-0086271

(51) Int. Cl.
*F04D 27/02* (2006.01)
*F04D 25/06* (2006.01)
(Continued)

(52) U.S. Cl.
CPC ..... *F04D 27/0246* (2013.01); *F04D 25/06* (2013.01); *F04D 27/001* (2013.01); *F04D 27/023* (2013.01); *F04D 27/0223* (2013.01); *F04D 27/0284* (2013.01); *F04D 29/462* (2013.01); *F04D 29/563* (2013.01)

(58) Field of Classification Search
CPC .. F04D 27/02–27; F04D 25/06; F04D 29/563; F04D 29/462; F04D 27/001
See application file for complete search history.

(56) References Cited

U.S. PATENT DOCUMENTS 4,139,328 A * 2/1979 Kuper ..... F04D 27/0284 415/1
2007/0110587 A1* 5/2007 Takeshita ..... F02C 7/236 417/26

(Continued)

FOREIGN PATENT DOCUMENTS

JP 8-254197 A 10/1996
JP 10-47079 A 2/1998

(Continued)

*Primary Examiner* — Peter J Bertheaud
*Assistant Examiner* — Dnyanesh G Kasture
(74) *Attorney, Agent, or Firm* — Sughrue Mion, PLLC

(57) ABSTRACT

A compressor control system includes: a compressor; an inlet guide vane (IGV) arranged at an inlet of the compressor, and configured to adjust opening of the inlet based on a supplementary surge control signal or a performance control signal; an anti-surge valve (ASV) connected to an outlet of the compressor, and configured to prevent a surge based on a surge control signal; and a controller configured to generate the surge control signal for controlling the ASV when an operating point enters a surge control range, generate the supplementary surge control signal for controlling the IGV in an anti-surge mode when the operating point enters a supplementary surge control range set between the surge control range and a surge range, and generate the performance control signal for controlling the IGV in a performance mode until the operating point enters the surge control range.

15 Claims, 9 Drawing Sheets

(51) Int. Cl.

| | |
|---|---|
| ***F04D 27/00*** | (2006.01) |
| ***F04D 29/46*** | (2006.01) |
| ***F04D 29/56*** | (2006.01) |

(56) References Cited

U.S. PATENT DOCUMENTS

| | | | | |
|---|---|---|---|---|
| 2011/0197593 | A1* | 8/2011 | Fuchs | F01D 15/10 60/773 |
| 2013/0251503 | A1 | 9/2013 | Park | |
| 2014/0314543 | A1 | 10/2014 | Park et al. | |
| 2017/0260988 | A1* | 9/2017 | Kim | F04D 27/0246 |

FOREIGN PATENT DOCUMENTS

| | | | |
|---|---|---|---|
| KR | 10-2012-0096748 | A | 8/2012 |
| KR | 10-2013-0107862 | A | 10/2013 |
| KR | 10-2014-0125681 | A | 10/2014 |

* cited by examiner

COMPRESSOR CONTROL SYSTEM AND METHOD

CROSS-REFERENCE TO THE RELATED APPLICATION

This application claims priority from Korean Patent Application No. 10-2016-0086271, filed on Jul. 7, 2016, in the Korean Intellectual Property Office, the disclosure of which is incorporated herein in its entirety by reference.

BACKGROUND

1. Field

Apparatuses and methods consistent with exemplary embodiments relate to compressor control, and more particularly, to compressor control that stably operates a compressor by preventing occurrence of a surge.

2. Description of the Related Art

A compressor compressing a fluid may be used in a fluid control system controlling a liquid or a gaseous fluid. A compressor may be designed to operate at high efficiency with respect to a possibly wide range of discharge a pressure and a flow, and not only the efficiency of the compressor but also an operating region thereof may act as important system performance parameters.

For example, in the case of a centrifugal turbo-compressor, if a pressure at a rear end of the compressor exceeds acceptable performance of the entire fluid control system when the compressor receives and compresses a gas, the compressor may no longer compress the gas and thus a periodic fluid backflow phenomenon may occur in the compressor, which may be referred to as a surge.

An impeller of a compressor may have a fixed pressure ratio at a constant speed and a constant density, and the fixed pressure ratio may be referred to as a specific pressure ratio of the compressor. A surge may occur when the compressor operates above its specific pressure ratio. A high-power compressor may be implemented by obtaining a high pressure ratio by increasing the number of stages of a compressor; however, a surge phenomenon may occur more frequently in a multi-stage compressor having many stages.

Most surge phenomena may occur shortly at a speed higher than reaction speed of instruments. In this case, when a fluid mechanical system fails to avoid a surge phenomenon and thus a surge phenomenon occurs therein, a fluid may periodically flow back, and thus, a pressure and a flow thereof may fluctuate. This fluctuation may generate a mechanical vibration and damage accessory elements such as bearings and impellers.

In this manner, since a surge phenomenon may degrade the performance of a compressor and shorten the life of a compressor, a function of preventing a surge phenomenon in operating a compressor (i.e., an anti-surge function) may be important in a compressor control system controlling a turbo-compressor. The anti-surge function may be technology for restoring a fluid system to normal or preventing occurrence of a surge therein by measuring and analyzing various characteristics of the fluid system caused by a surge phenomenon.

When an anti-surge valve (ASV) is used to implement the anti-surge function, the resistance of the fluid system may be reduced to prevent occurrence of a surge phenomenon therein.

Also, in addition to the ASV, the compressor control system may include an inlet guide vane (IGV) installed at an inlet of the compressor to control an operating region of the compressor.

FIG. 1 is a graph illustrating a performance map of a compressor.

In FIG. 1, the vertical axis represents pressures or pressure ratios, and the horizontal axis represents parameters such as flows or motor currents representing flows.

As for surge control, a surge control range is set to have a margin of about 7% to about 10% from a surge range in consideration of a measurement error in a sensor, a temperature change in an intercooler, or a transient response in compressor control, and control is performed to move an operating point away from the surge range by adjusting an IGV or an ASV when the operating point reaches the surge control range.

Also, in order to adjust a pressure of a fluid system to a set pressure, IGV control is performed as follows. That is, when a current outlet pressure of the compressor is lower than a set pressure, the IGV is opened by a pressure gap or difference to adjust the pressure of the fluid system to the set pressure; and when the current outlet pressure of the compressor is higher than the set pressure, the IGV is closed by the pressure gap. By this IGV control, the current outlet pressure of the compressor may follow the set pressure.

A centrifugal turbo-compressor operates in a range of a turndown that is a flow variation from a design point of a performance curve to the surge control range before occurrence of a surge phenomenon.

When a flow decreases rapidly in the compressor operating in the turndown, since the outlet pressure increases and thus the operating point enters a region of the surge control range, both the IGV and the ASV operate. When the IGV is further closed, since an intake flow of the compressor decreases, a flow of the entire compressor decreases and thus the operating point moves toward the surge range. In this case, when the operating point approaches the region of the surge control range in a state where the pressure is higher than the set pressure, since an IGV pressure controller controls the IGV in a direction of further closing the IGV, a possibility of occurrence of a surge phenomenon increases.

FIG. 2 is a graph illustrating a coupling phenomenon occurring in an IGV and an ASV in a compressor of FIG. 1.

For example, if the compressor is controlled at an operating point represented by "A" in FIG. 2, a direction for controlling the IGV and a direction for controlling the ASV may collide with each other. That is, in order to reduce the pressure thereof, the IGV has to be controlled in a direction of reducing (closing) an opening degree of the IGV (an aperture of the IGV). When the control is performed to reduce the aperture of the IGV, since the flow and pressure thereof decrease, a control point of the IGV moves in a direction toward the bottom left side in FIG. 2.

However, in order to increase a flow to prevent a surge phenomenon, the ASV has to be controlled in a direction of opening an aperture of the ASV. When the control is performed to open the aperture of the ASV, since the flow thereof increases and the pressure thereof decreases, a control point of the ASV moves in a direction toward the bottom right side in FIG. 2. In this manner, since a collision occurs between the control operations of the IGV and the ASV, and therefore, a pressure hunting phenomenon occurs and thus an unstable flow is repeated, the operation of the compressor becomes unstable.

This coupling phenomenon occurs because the discharge pressure of the compressor is controlled by the operation of the IGV but the flow thereof is influenced by the operation of the IGV, and the control based on the flow of the compressor may be performed by the operation of the ASV but the pressure thereof is influenced by the operation of the ASV. Thus, since two valves of the IGV and the ASV interfere with each other in a surge region, it becomes difficult to control the entire system of the compressor.

In order to avoid a collision problem between the control operations of the ASV and the IGV as described above, the control gains of a proportional integral derivative (PID) controller for controlling the IGV and the ASV may be set to be different from each other, and the control gain of any one of the IGV and the ASV may be set to be dominant, thereby reducing the collision in the surge region. However, this gain control method may be complex and difficult in terms of controller tuning, and may fail to perfectly cope with the coupling phenomenon.

For example, when the IGV gain is set to be greater than the ASV gain, since the pressure thereof may be stabilized but the operating point thereof may enter the surge region, a possibility of causing a surge phenomenon may increase or it may be difficult to cope with a rapid change in the flow consumption at the rear end of the compressor.

Also, when the ASV gain is set to be greater than the IGV gain, since the ASV may be rapidly opened when the operating point enters the surge region, the width of a pressure drop may increase. In this case, it may be possible to cope with a rapid flow consumption change, but the operation of the compressor may become unstable because the width of a pressure drop may increase.

SUMMARY

Exemplary embodiments of the inventive concept provide compressor control systems and methods that may stably operate a compressor by preventing occurrence of a surge.

The exemplary embodiments also provide compressor control systems and methods that may control an operation of a compressor while minimizing the mutual influence between a control operation of an inlet guide vane (IGV) and a control operation of an anti-surge valve (ASV).

Various aspects of the inventive concept will be set forth in part in the description which follows and, in part, will be apparent from the description, or may be learned by practice of the presented embodiments.

According to one or more exemplary embodiments, there is provided a compressor control system which may include: a compressor configured to compress a fluid; IGV arranged at an inlet of the compressor, and configured to adjust opening of the inlet by control of a supplementary surge control signal or a performance control signal; an ASV connected to an outlet of the compressor, and configured to prevent a surge in the compressor by control of a surge control signal; and a controller configured to generate the surge control signal for controlling the ASV in response to an operating point of the compressor entering a surge control range, generate the supplementary surge control signal for controlling the IGV in an anti-surge mode in response to the operating point of the compressor entering a supplementary surge control range set between the surge control range and a surge range where the compressor generates a surge, and generate the performance control signal for controlling the IGV in a performance mode until the operating point of the compressor enters the surge control range.

The compressor control system may further include: a motor configured to drive the compressor; a pressure sensor configured to detect a fluid pressure at the outlet of the compressor; a flow sensor configured to detect a fluid flow at the outlet of the compressor; and a current sensor configured to detect a current change in the motor, wherein the controller may include: an ASV controller configured to receive at least one of a signal output from the pressure sensor as a result of detecting the fluid pressure and a signal output from the flow sensor as a result of detecting the fluid flow, to generate the surge control signal; and an IGV controller configured to receive at least one of a signal output from the current sensor as a result of detecting the current change, the signal output from the pressure sensor, and the signal output from the flow sensor, to generate the supplementary surge control signal and the performance control signal.

The ASV controller may include: a pressure control signal generator configured to receive the signal output from the pressure sensor to generate a pressure control signal; a surge signal generator configured to receive the at least one of the signal output from the pressure sensor and the signal output from the flow sensor to generate the surge control signal; and a first selector configured to output one of the pressure control signal and the surge control signal.

The IGV controller may include: a performance controller configured to receive at least one of the signal output from the pressure sensor and the signal output from the current sensor to generate the performance control signal; a supplementary surge signal generator configured to receive at least one of the signal output from the flow sensor and the signal output from the pressure sensor to generate the supplementary surge control signal; and a second selector configured to select and output one of the performance control signal and the supplementary surge control signal.

The performance controller may include: a first opening controller configured to receive the signal output from the pressure sensor to generate a first opening signal for opening the inlet through the IGV; a second opening controller configured to receive the signal output from the current sensor to generate a second opening signal for opening the inlet through the IGV; and a third selector configured to select and output one of the first opening signal and the second opening signal as the performance control signal.

According to one or more embodiments, there is provided a compressor control method which may include: an IGV performance control operation of generating a performance control signal to control an IGV adjusting opening of an inlet of a compressor compressing a fluid in a performance mode until an operating point of the compressor enters a surge control range; an ASV control operation of generating a surge control signal to control an ASV connected to an outlet of the compressor to prevent a surge in the compressor in response to the operating point of the compressor entering the surge control range; and an IGV anti-surge control operation of generating a supplementary surge control signal to control the IGV in an anti-surge mode in response to the operating point of the compressor entering a supplementary surge control range set between the surge control range and a surge range where the compressor generates a surge during execution of the ASV control operation.

The compressor control method may further include: an operating point detecting operation of detecting the operating point of the compressor from at least one of a signal output from a pressure sensor detecting a fluid pressure at the outlet of the compressor, a signal output from a flow sensor detecting a fluid flow at the outlet of the compressor, and a signal output from a current sensor detecting a current change in a motor driving the compressor.

The compressor control method may further include, in the IGV performance control operation, a pressure control signal generating operation of generating a pressure control signal for adjusting opening of the ASV from the signal output from the pressure sensor until the operating point of the compressor enters the surge control range.

BRIEF DESCRIPTION OF THE DRAWINGS

These and/or other aspects will become apparent and more readily appreciated from the following description of the exemplary embodiments, taken in conjunction with the accompanying drawings in which.

DETAILED DESCRIPTION

Figure 1:
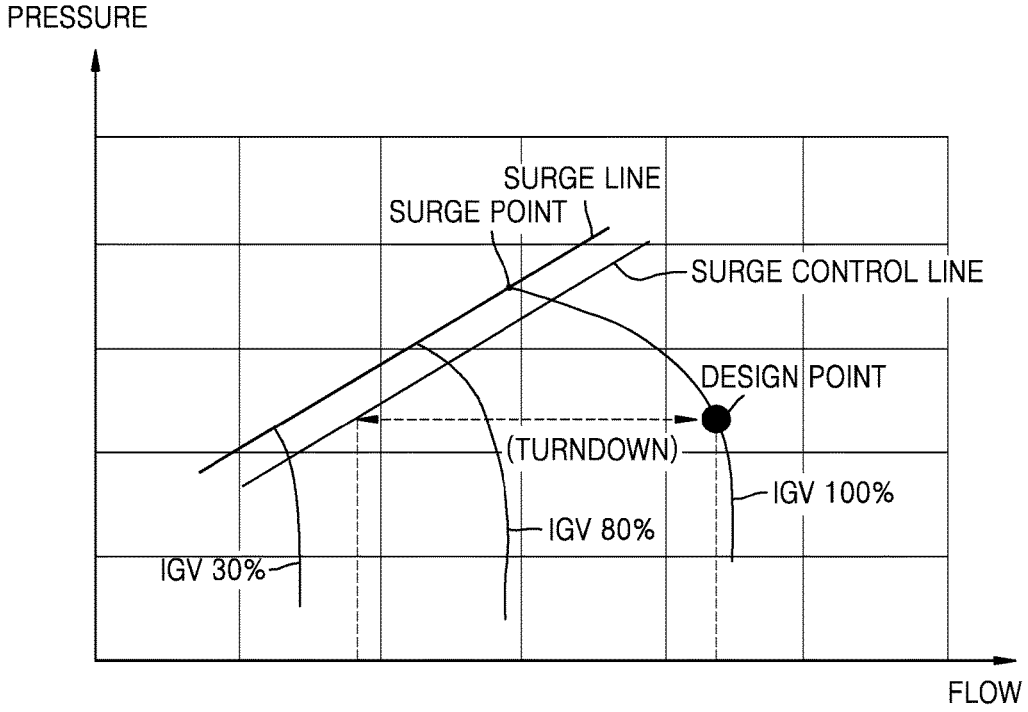
FIG. 1 is a graph illustrating a compressor control system and method according to the related art.
Figure 2:
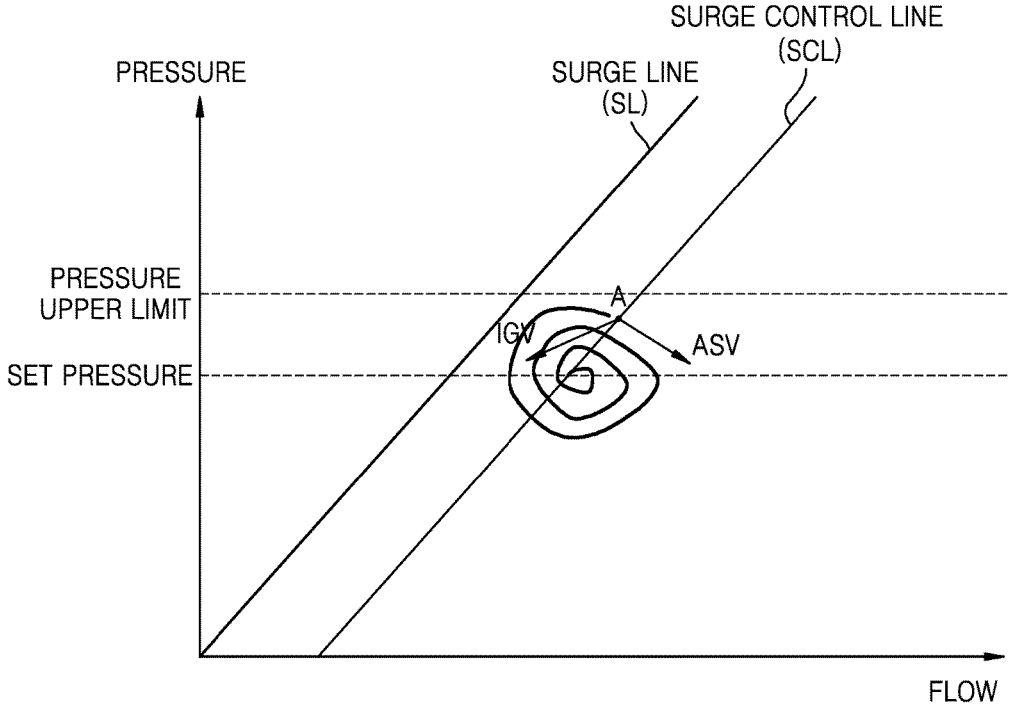
FIG. 2 is a graph illustrating a coupling phenomenon occurring in an IGV and an ASV in the related art compressor of FIG. 1.

Reference will now be made in detail to exemplary embodiments along with accompanying drawings, wherein like reference numerals refer to like elements throughout. In this regard, the presented embodiments may have different forms and should not be construed as being limited to the descriptions set forth herein. Accordingly, the exemplary embodiments are merely described below, by referring to the figures, to explain aspects of the inventive concept. As used herein, the term "and/or" includes any and all combinations of one or more of the associated listed items. Expressions such as "at least one of," when preceding a list of elements, modify the entire list of elements and do not modify the individual elements of the list.

Hereinafter, the configurations and operations of compressor control systems and methods according to exemplary embodiments will be described in detail with reference to the accompanying drawings.

Figure 3:
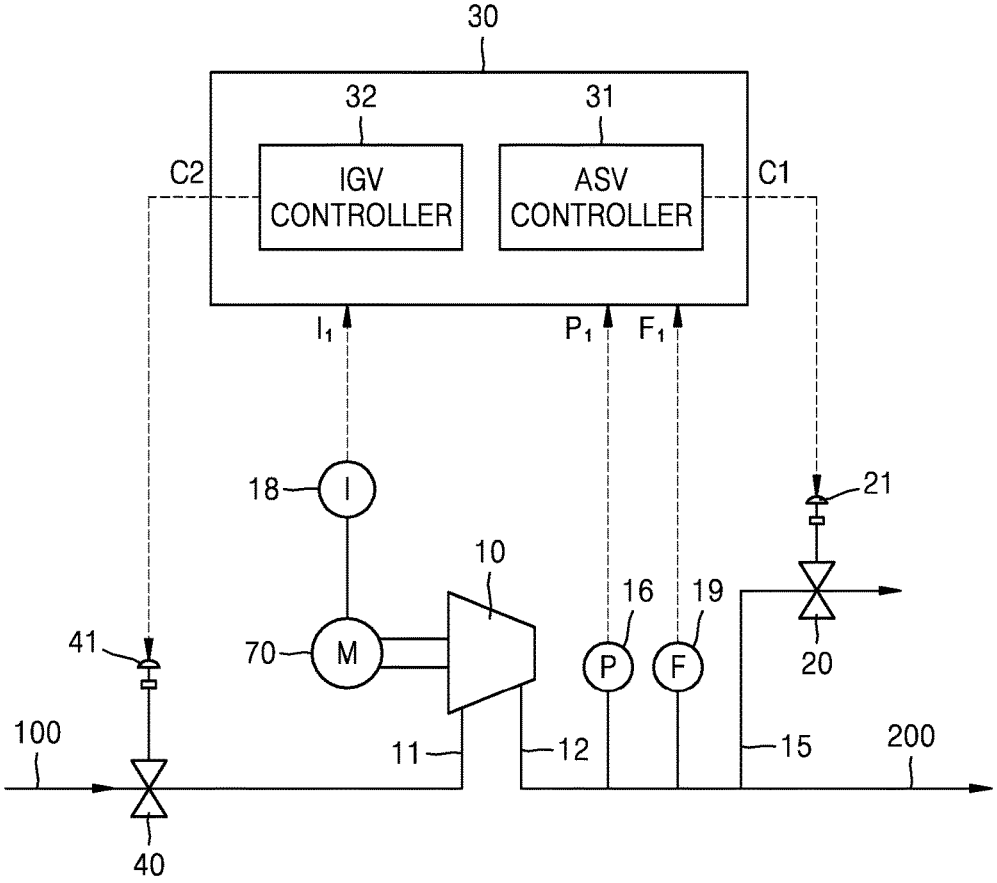
FIG. 3 is a block diagram illustrating a schematic configuration of a compressor control system according to an exemplary embodiment.

FIG. 3 is a block diagram illustrating a schematic configuration of a compressor control system according to an exemplary embodiment.

The compressor control system according to the exemplary embodiment illustrated in FIG. 3 may include a compressor 10, an inlet guide vane (IGV) 40 arranged at an inlet 11 of the compressor 10 to adjust opening of the inlet 11 by control of a supplementary surge control signal or a performance control signal applied from an outside, an anti-surge valve (ASV) 20 connected to an outlet 12 of the compressor 10 to prevent a surge in the compressor 10 by control of a surge control signal applied from an outside, and a controller 30 controlling the IGV 40 and the ASV 20.

The compressor 10 may receive a fluid having certain inlet conditions, increase a pressure thereof, and supply a compressed fluid to a fluid system or equipment in operation. The compressor 10 may include one or more suitable types of compressors, such as centrifugal compressors and/or axial-flow compressors.

Since a supply pipe 100 is connected to the inlet 11 of the compressor 10 and a discharge pipe 200 is connected to the outlet 12 of the compressor 10, the compressor 10 may receive a fluid supplied through the supply pipe 100, compress the fluid, and discharge the compressed fluid through the discharge pipe 200.

Although a gas is used as a fluid passing through various fluid mechanical elements including the compressor 10 in an exemplary embodiment, the inventive concept is not limited by this fluid type and, for example, a liquid may also be used as the fluid.

A bypass line 15 may be connected to the outlet 12 of the compressor 10, and the ASV 20 may be arranged at the bypass line 15. The bypass line 15 may discharge the fluid to the outside, and an end portion of the bypass line 15 may be connected to the inlet 11 of the compressor 10.

For example, when the end portion of the bypass line 15 is connected to the inlet 11 of the compressor 10, the bypass line 15 may form a connecting path allowing the fluid to flow between the inlet 11 and the outlet 12 of the compressor 10 without passing through the compressor 10. That is, when the bypass line 15 is opened, the fluid discharged from the compressor 10 may flow to the inlet 11 of the compressor 10, thereby reducing a difference between an outlet-side pressure and an inlet-side pressure of the compressor 10 and increasing a flow into the compressor 10.

Thus, the ASV 20 may control opening/closing of the bypass line 15 to prevent occurrence of a surge in the compressor 10. The ASV 20 may be implemented, for example, by electromagnetic valves such as solenoid valves for electronic control.

The ASV 20 may be connected to an ASV actuator 21 operated by a first signal C1 applied from an ASV controller 31. Thus, the ASV 20 may prevent occurrence of a surge in the compressor 10 by control of the first signal C1. When the ASV 20 operates by the first signal C1 to prevent occurrence of a surge in the compressor 10, the first signal C1 may correspond to a surge control signal.

The IGV 40 may be arranged at the inlet 11 of the compressor 10 to adjust opening of the inlet 11. The IGV 40 may be implemented, for example, by electromagnetic valves such as solenoid valves for electronic control.

The IGV 40 may be connected to an IGV actuator 41 controlled by a second signal C2 applied from an IGV controller 32. Thus, the IGV 40 may adjust opening of the inlet 11 of the compressor 10 by control of the second signal C2 applied from the controller 30.

The controller 30 may be electrically connected to the ASV 20 and the IGV 40. The controller 30 may include the ASV controller 31 generating the first signal C1 for controlling the ASV 20, and the IGV controller 32 generating the second signal C2 for controlling the IGV 40.

The controller 30 may be implemented to include, for example, a circuit board mounted in a control computer of the compressor control system, a computer chip mounted on a circuit board, or software installed in a computer chip or a control computer.

The compressor 10 may be driven by a motor 70 operating by an electrical signal. A current sensor 18 may be connected to the motor 70 to detect a current change in the motor 70 and transmit a current signal $I_1$ to the controller 30.

A pressure sensor 16 may be connected to the outlet 12 of the compressor 10 to measure a fluid pressure at the outlet 12 of the compressor 10 and transmit a pressure signal $P_1$ to the controller 30. Also, a flow sensor 19 may be connected to the outlet 12 of the compressor 10 to measure a fluid flow at the outlet 12 of the compressor 10 and transmit a flow signal $F_1$ to the controller 30.

Figure 4:
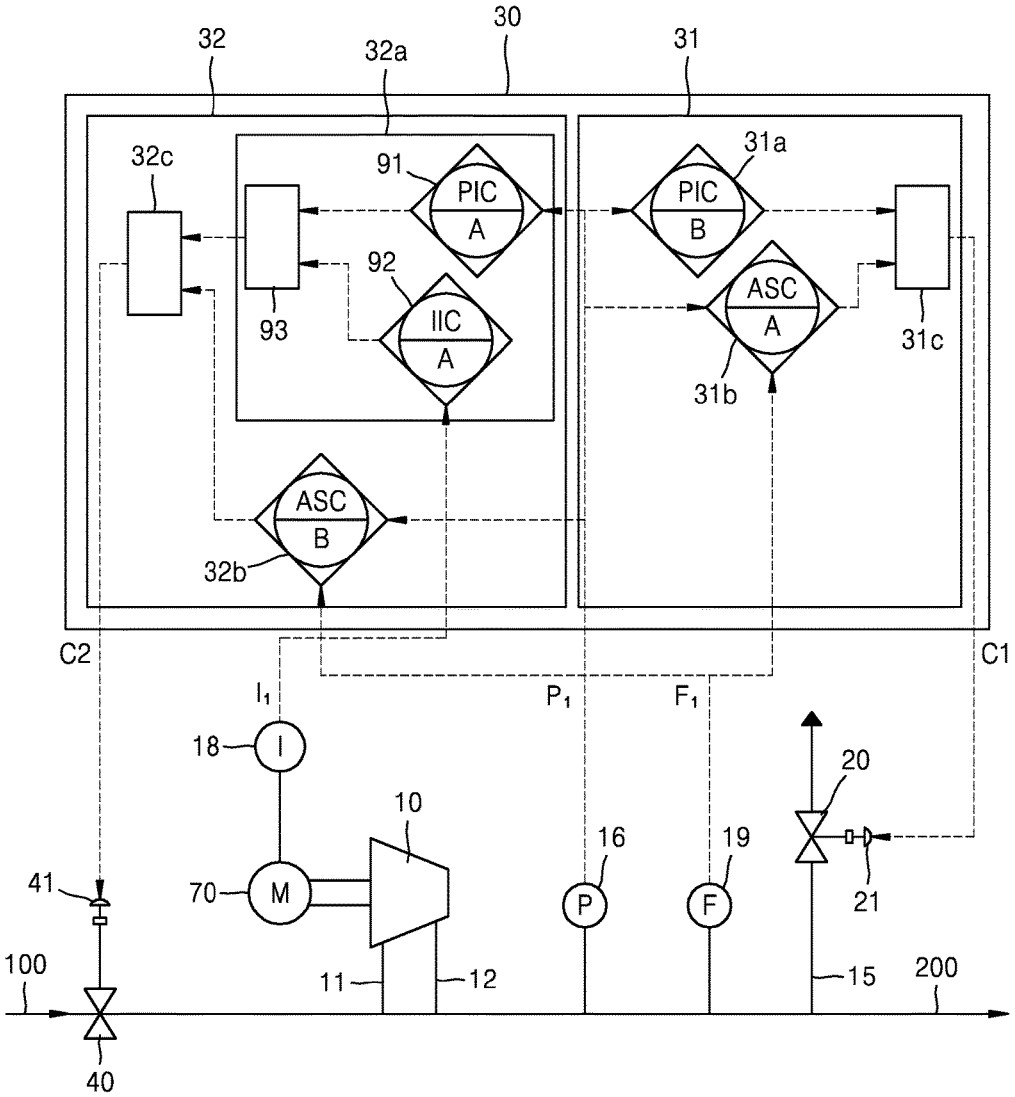
FIG. 4 is a block diagram of a compressor control system according to another exemplary embodiment illustrating a part of the compressor control system according to the exemplary embodiment illustrated in FIG. 3.

FIG. 4 is a block diagram of a compressor control system according to another exemplary embodiment illustrating a part of the compressor control system according to the exemplary embodiment illustrated in FIG. 3. FIG. 4 illustrates a specific implementation example of the ASV controller 31 and the IGV controller 32 of the compressor control system illustrated in FIG. 3.

The ASV controller 31 of the controller 30 may receive the pressure signal $P_1$ of the pressure sensor 16 and the flow signal $F_1$ of the flow sensor 19 to generate the first signal C1. The IGV controller 32 of the controller 30 may receive the current signal $I_1$ of the current sensor 18, the pressure signal $P_1$ of the pressure sensor 16, and the flow signal $F_1$ of the flow sensor 19 to generate the second signal C2 for controlling the IGV 40.

The ASV controller 31 may include a pressure control signal generator 31*a* receiving the pressure signal $P_1$ of the pressure sensor 16 to generate a pressure control signal, a surge signal generator 31*b* receiving the pressure signal $P_1$ of the pressure sensor 16 and the flow signal $F_1$ of the flow sensor 19 to generate a surge control signal, and a first selector 31*c* selecting and outputting one of the pressure control signal of the pressure control signal generator 31*a* and the surge control signal of the surge signal generator 31*b* as the first signal C1. For example, the first selector 31*c* may be implemented as a minimum value selector selecting a minimum value from among input values, that is, a lower value signal between the pressure control signal and the surge control signal.

When the pressure control signal of the pressure control signal generator 31*a* is selected and output as the first signal C1 by the first selector 31*c*, the ASV 20 may adjust the pressure and flow of the entire fluid system by operating in conjunction with the IGV 40.

When the surge control signal of the surge signal generator 31*b* is selected and output as the first signal C1 by the first selector 31*c*, the ASV 20 may operate to prevent occurrence of a surge in the compressor 10.

The IGV controller 32 may include a performance controller 32*a* receiving the pressure signal $P_1$ of the pressure sensor 16 and the current signal $I_1$ of the current sensor 18 to generate a performance control signal, a supplementary surge signal generator 32*b* receiving the flow signal $F_1$ of the flow sensor 19 and the pressure signal $P_1$ of the pressure sensor 16 to generate a supplementary surge control signal, and a second selector 32*c* selecting and outputting one of the performance control signal of the performance controller 32*a* and the supplementary surge control signal of the supplementary surge signal generator 32*b* as the second signal C2. For example, the second selector 32*c* may be implemented as a maximum value selector selecting a maximum value from among input values, that is, a greater value signal between the performance control signal and the supplementary surge control signal.

When the supplementary surge control signal of the supplementary surge signal generator 32*b* is selected and output as the second signal C2 by the second selector 32*c*, the IGV 40 may finely adjust opening of the inlet 11 of the compressor 10 by operating in an anti-surge mode to assist the operation of the ASV 20 for preventing occurrence of a surge in the compressor 10.

When the performance control signal of the performance controller 32*a* is selected and output as the second signal C2 by the second selector 32*c*, the IGV 40 may operate in a performance mode for maximizing operation performance of the compressor 10 by performing pressure control for controlling a pressure of the compressor 10 and current control based on a current change in the motor 70 driving the compressor 10.

The performance controller 32*a* of the IGV controller 32 may include a first opening controller 91 receiving the pressure signal $P_1$ of the pressure sensor 16 to generate a first opening signal for opening the inlet 11 through the IGV 40, a second opening controller 92 receiving the current signal $I_1$ of the current sensor 18 to generate a second opening signal for opening the inlet 11 through the IGV 40, and a third selector 93 comparing the first opening signal with the second opening signal to output the performance control signal. For example, the third selector 93 may be implemented as a minimum value selector selecting a minimum value from among input values, that is, a lower value signal between the first opening signal and the second opening signal.

The first opening controller 91 may adjust opening of the inlet 11 of the compressor 10 to control an operating pressure of the compressor 10 based on the pressure signal $P_1$ of the pressure sensor 16. The second opening controller 92 may adjust opening of the inlet 11 of the compressor 10 based on the current signal $I_1$ of the current sensor 18.

Figure 5:
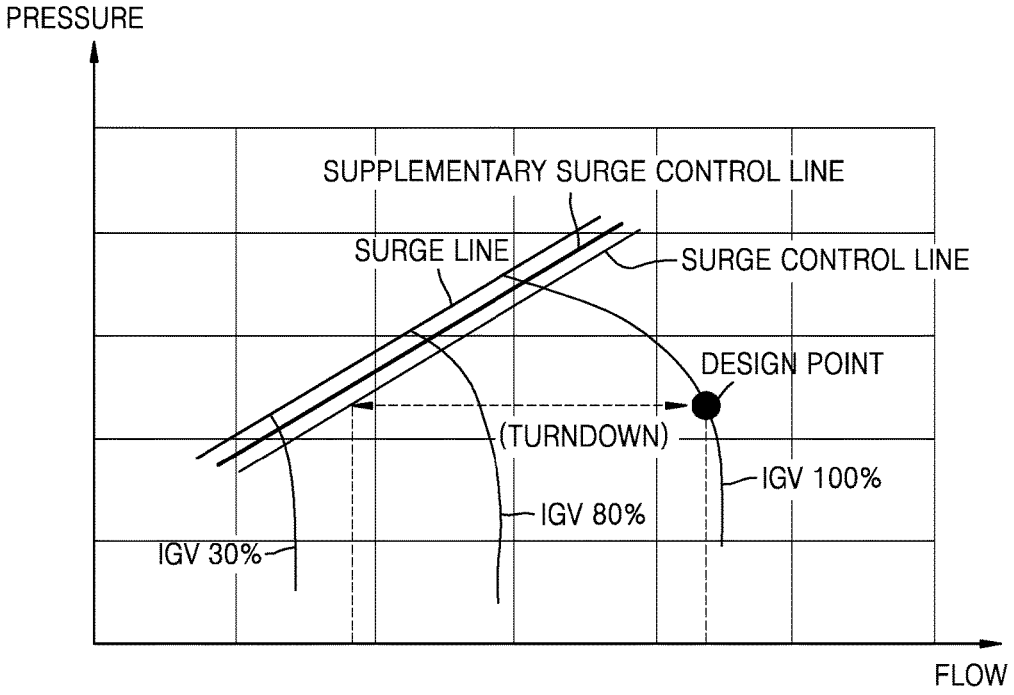
FIG. 5 is a graph illustrating an operation of the compressor control system of FIGS. 3 and 4, according to an exemplary embodiment.

FIG. 5 is a graph illustrating an operation of the compressor control system of FIGS. 3 and 4, according to an exemplary embodiment.

In the compressor control system according to the exemplary embodiment illustrated in FIGS. 3 and 4, a surge control range may be set to have a margin from a surge range, and a supplementary surge control range may be set between the surge range and the surge control range to change an operation of controlling an IGV and an ASV according to a case where an operating point of a compressor moves between the surge control range and the supplementary surge control range and a case where the operating point of the compressor enters the supplementary surge control range and gets closer to the surge range.

The controller 30 may generate a surge control signal for controlling the ASV 20 when the operating point of the compressor 10 enters the surge control range. The controller 30 may generate a supplementary surge control signal for finely controlling the IGV 40 in an anti-surge mode when the operating point of the compressor 10 enters the supplementary surge control range set between the surge control range and the surge range generating a surge. In the anti-surge mode, opening of the inlet 11 may be adjusted by the IGV 40 such that opening of the inlet 11 of the compressor 10 changes more finely than in a performance mode.

The controller 30 may generate a performance control signal for controlling the IGV 40 in the performance mode until the operating point of the compressor 10 enters the surge control range. In the performance mode, opening of the inlet 11 may be adjusted by the IGV 40 such that opening of the inlet 11 of the compressor 10 changes more rapidly than in the anti-surge mode. Here, in order to finely control, adjust or change opening of the inlet 11 in the anti-surge mode, the controller 30 may more slowly open or close the inlet 11 than in the performance mode, and/or make an amount or degree of opening or closing of the inlet 11 smaller in the anti-surge mode than in the performance mode.

Also, until the operating point of the compressor 10 enters the surge control range, since the controller 30 transmits the pressure control signal to the ASV 20, the ASV 20 may adjust a pressure and a flow of the entire fluid system by operating in conjunction with the IGV 40.

In the case of general surge control according to the related art, only a surge control range is set to have a margin from a surge range and control is performed to move the operating point away from the surge range by operating the ASV when the operating point of a compressor enters the surge control range. According to the general surge control, the ASV does not operate before the operating point reaches the surge control range, but both the IGV and the ASV operate when the operating point enters the surge control range. Since both the IGV and the ASV change a flow and a pressure of the compressor, a coupling phenomenon may occur when the IGV and the ASV operate together.

However, according to the compressor control system according to the exemplary embodiments illustrated in FIGS. 3 and 4, when the operating point of the compressor 10 moves in a general operation state before entering the surge control range, both the IGV 40 and the ASV 20 may operate in cooperation to maximize the performance of the compressor 10. Also, when the operating point of the compressor 10 enters the surge control range, the ASV 20 may first start an operation for preventing occurrence of a surge in the compressor 10. In this case, the IGV 40 may operate in the performance mode for optimizing the performance of the compressor 10.

When the operating point of the compressor 10 enters the supplementary surge control range, the IGV 40 may also operate finely in the anti-surge mode for preventing occurrence of a surge in the compressor 10. That is, in order to prevent occurrence of a surge in the compressor 10, in a state where the ASV 20 is opened to increase a flow and reduce a pressure, the IGV 40 may finely perform an operation of closing the inlet 11 of the compressor 10 to avoid a surge in the compressor 10 without operating rapidly in a direction of closing the inlet 11 of the compressor 10. In this manner, since the IGV 40 may assist the ASV 20 to operate to avoid a surge occurrence, thereby to avoid a phenomenon of the operating point of the compressor 10 moving toward the surge range, the operating point of the compressor 10 may move outside the surge control range (i.e., toward the right side of the surge control range in FIG. 5) by the cooperative operation of the IGV 40 and the ASV 20.

Figure 6:
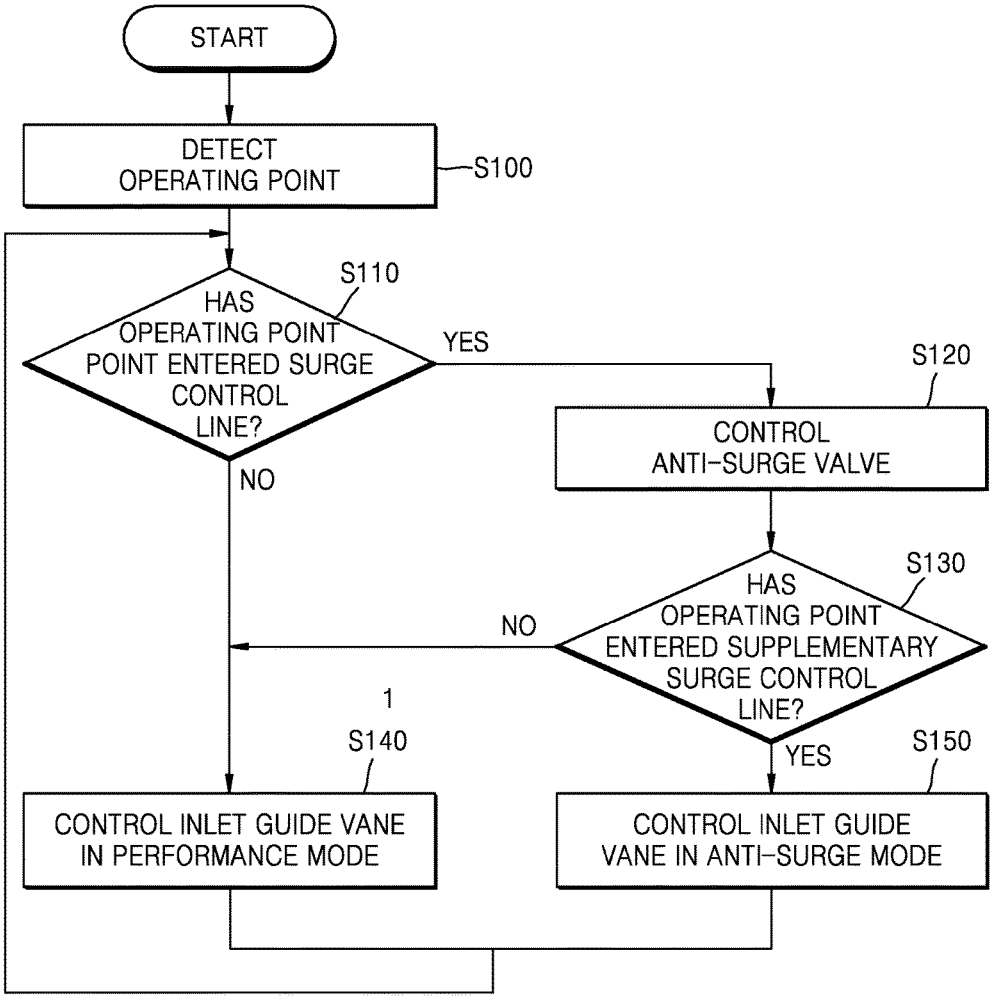
FIG. 6 is a flowchart schematically illustrating operations of a compressor control method, according to another exemplary embodiment.

FIG. 6 is a flowchart schematically illustrating operations of a compressor control method according to another exemplary embodiment.

The compressor control method according to the exemplary embodiment illustrated in FIG. 6 may include: an IGV performance control operation S140 of generating a performance control signal to control an IGV adjusting opening of an inlet of a compressor compressing a fluid in a performance mode until an operating point of the compressor enters a surge control range; an ASV control operation S120 of generating a surge control signal to control an ASV connected to an outlet of the compressor to prevent a surge in the compressor when the operating point of the compressor enters the surge control range; and an IGV anti-surge control operation S150 of generating a supplementary surge control signal to finely control the IGV in an anti-surge mode when the operating point of the compressor enters a supplementary surge control range set between the surge control range and a surge range where the compressor generates a surge during execution of the ASV control operation S120.

The compressor control method may further include an operating point detecting operation S100 of detecting the operating point of the compressor from a signal of a pressure sensor detecting a fluid pressure at an outlet of the compressor, a flow sensor detecting a fluid flow at the outlet of the compressor, and a current sensor detecting a current change in a motor driving the compressor, to determine whether the operating point of the compressor has entered the surge control range (S110) and execute the IGV performance control operation S140 of controlling the IGV in the performance mode until the operating point of the compressor enters the surge control range.

A pressure control signal generating operation may be executed to generate a pressure control signal for controlling the ASV to maintain the performance of the compressor by assisting the operation of the IGV during the execution of the IGV performance control operation S140.

Figure 7:
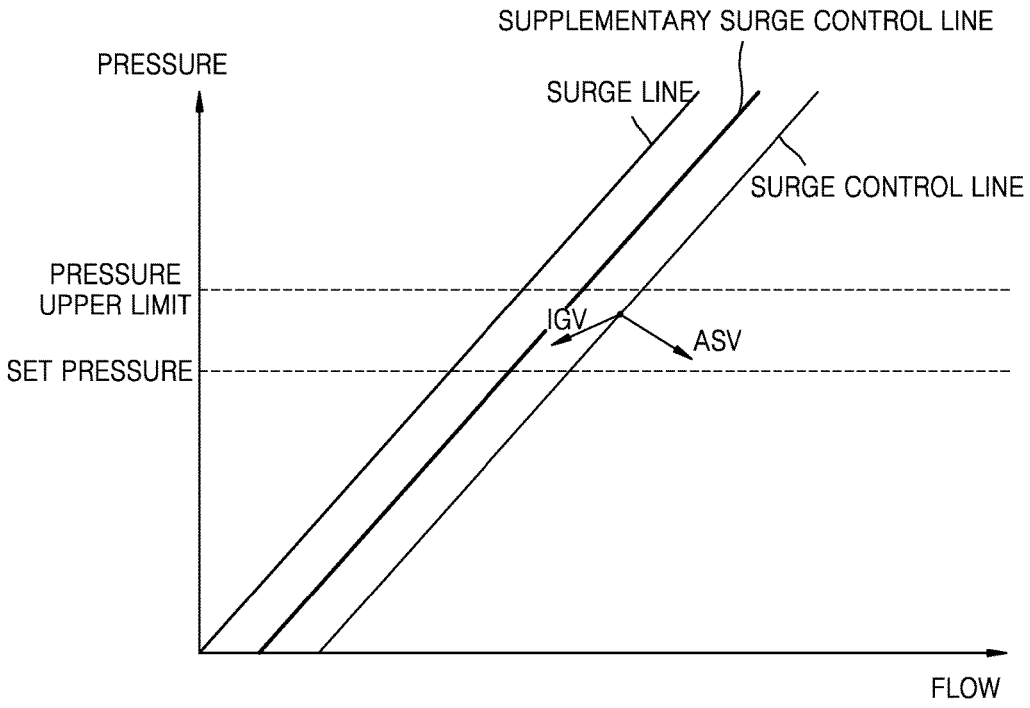
FIG. 7 is a graph illustrating an operation example of the compressor control method of FIG. 6, according to an exemplary embodiment.

FIG. 7 is a graph illustrating an operation example of the compressor control method of FIG. 6, according to an exemplary embodiment.

An ASV control operation S120 may be executed to generate a surge control signal to control the ASV connected to the outlet of the compressor to prevent a surge in the compressor when the operating point of the compressor enters the surge control range.

Also, after the operating point of the compressor enters the surge control range, the IGV may be controlled in the performance mode until the operating point of the compressor enters the supplementary surge control range.

An IGV performance control operation S140 may be executed to control the IGV in the performance mode until the operating point of the compressor enters the supplementary surge control range while the ASV control operation S120 is being performed after the operating point of the compressor enters the surge control range. As illustrated in FIG. 7, until the operating point of the compressor enters the supplementary surge control range, a size of a signal controlling the IGV may be maintained and the IGV may be controlled in the performance mode for maintaining the performance of the compressor.

Figure 8:
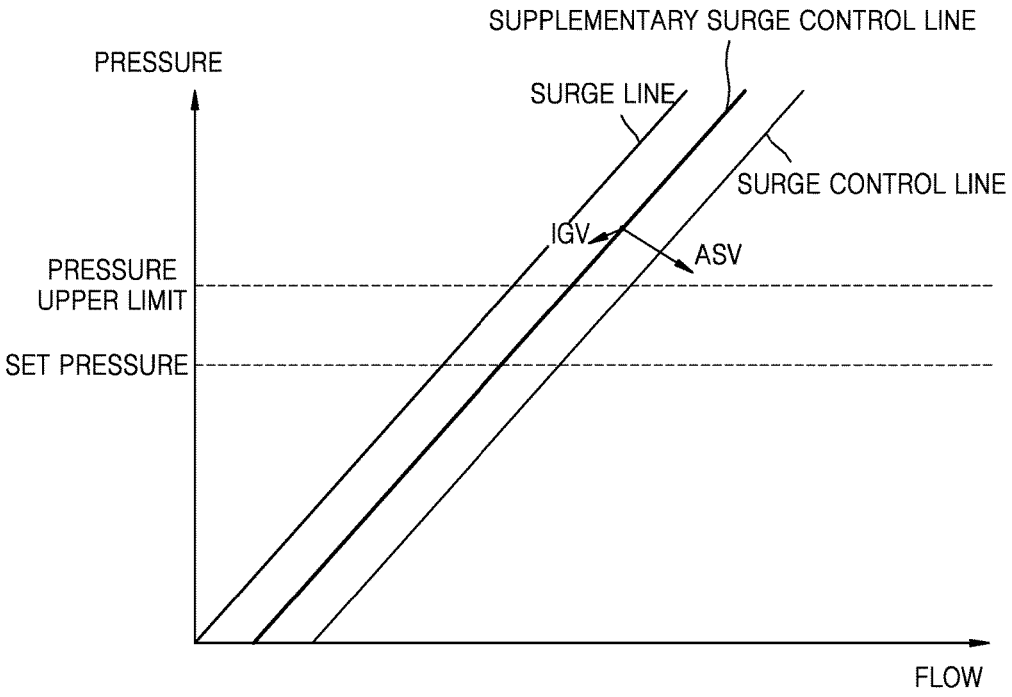
FIG. 8 is a graph illustrating another operation example of the compressor control method of FIG. 6, according to an exemplary embodiment.

FIG. 8 is a graph illustrating another operation example of the compressor control method of FIG. 6, according to an exemplary embodiment.

An IGV anti-surge control operation S150 may be executed to generate a supplementary surge control signal to finely control the IGV in the anti-surge mode when the operating point of the compressor enters the supplementary surge control range while the ASV control operation S120 is being performed after the operating point of the compressor enters the surge control range.

In the IGV anti-surge control operation, since the IGV may be finely adjusted to assist an anti-surge control function of the ASV by a pressure control function of the IGV, a pressure control function of the IGV may be weakened. In this manner, since the influence of the control operation of the ASV among the influences of the control operations of two elements of the IGV and the ASV is set to be dominant in the region between the supplementary surge control range and the surge range, the operating point of the compressor may rapidly escape from the region having a possibility of generating a surge, by the cooperative operation of the ASV and the IGV.

Figure 9:
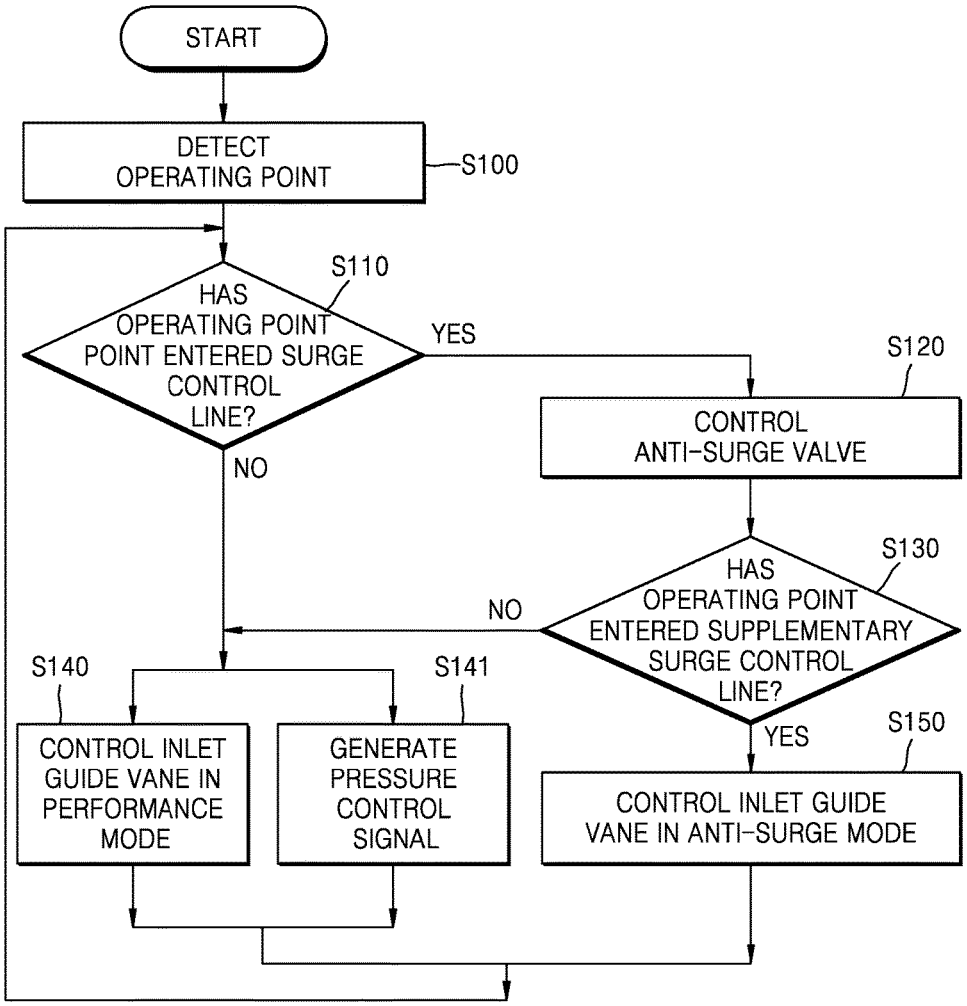
FIG. 9 is a flowchart schematically illustrating operations of a compressor control method, according to another exemplary embodiment.

FIG. 9 is a flowchart schematically illustrating operations of a compressor control method according to another exemplary embodiment.

The compressor control method according to the exemplary embodiment illustrated in FIG. 9 may include: an IGV performance control operation S140 of generating a performance control signal to control an IGV adjusting opening of an inlet of a compressor compressing a fluid in a performance mode until an operating point of the compressor enters a surge control range; a pressure control signal generating operation S141 of generating a pressure control signal for controlling an ASV to maintain a performance of the compressor by assisting an operation of the IGV during execution of the IGV performance control operation S140; an ASV control operation S120 of generating a surge control signal to control the ASV connected to an outlet of the compressor to prevent a surge in the compressor when the operating point of the compressor enters the surge control range; and an IGV anti-surge control operation S150 of generating a supplementary surge control signal to finely control the IGV in an anti-surge mode when the operating point of the compressor enters a supplementary surge control range set between the surge control range and a surge range where the compressor generates a surge during execution of the ASV control operation S120.

In the pressure control signal generating operation S141, since the pressure control signal is transmitted to the ASV until the operating point of the compressor enters the surge control range, the ASV may adjust the pressure and the flow of the fluid by operating in conjunction with the IGV.

According to the compressor control systems and methods according to the above exemplary embodiments, the compressor may be stably controlled because the supplementary surge control range may be set between the surge control range for controlling the ASV and the surge range where a surge occurs in the compressor, and the IGV may also operate finely in the anti-surge mode for preventing occurrence of a surge in the compressor when the operating point of the compressor enters the supplementary surge control range.

The descriptions of the configurations and effects according to the above exemplary embodiments are merely examples, and those of ordinary skill in the art will understand that various modifications and other equivalent embodiments may be derived therefrom. Thus, the spirit and scope of the inventive concept should be defined by the appended claims.

It should be understood that the exemplary embodiments described herein should be considered in a descriptive sense only and not for purposes of limitation. Descriptions of features or aspects within each embodiment should typically be considered as available for other similar features or aspects in other embodiments.

While the above exemplary embodiments have been described with reference to the figures, it will be understood by those of ordinary skill in the art that various changes in form and details may be made therein without departing from the spirit and scope of the inventive concept as defined by the following claims.

What is claimed is:

1. A compressor control system comprising:

a compressor configured to compress a fluid;

an inlet guide vane (IGV) arranged at an inlet of the compressor, and configured to adjust opening of the inlet based on a supplementary surge control signal or a performance control signal;

an anti-surge valve (ASV) connected to an outlet of the compressor, and configured to prevent a surge in the compressor based on a surge control signal; and a controller comprising a circuit programmed to:

generate the surge control signal for controlling the ASV based on an operating point of the compressor reaching a surge control line;

generate the supplementary surge control signal for controlling the IGV in an anti-surge mode based on the operating point of the compressor reaching a supplementary surge control line set between the surge control line and a surge line where the compressor generates a surge, the supplementary surge control signal controlling the IGV to adjust the opening of the inlet at a first rate; and generate the performance control signal for controlling the IGV in a performance mode until the operating point of the compressor reaches the surge control line, the performance control signal controlling the IGV to adjust the opening of the inlet at a second rate higher than the first rate.

2. The compressor control system of claim 1, further comprising a bypass line connecting the outlet of the compressor to the inlet of the compressor so that the fluid discharged from the outlet flows between the outlet and the inlet at a control of the ASV without passing through the compressor.

3. The compressor control system of claim 1, further comprising:

a motor configured to drive the compressor;

a pressure sensor provided between the compressor and the ASV and configured to detect a fluid pressure at the outlet of the compressor;

a flow sensor provided between the compressor and the ASV and configured to detect a fluid flow at the outlet of the compressor; and a current sensor configured to detect a current change in the motor, wherein the controller comprises:

an ASV controller programmed to receive at least one of a signal output from the pressure sensor as a result of detecting the fluid pressure and a signal output from the flow sensor as a result of detecting the fluid flow, to generate the surge control signal; and an IGV controller programmed to receive at least one of a signal output from the current sensor as a result of detecting the current change, the signal output from the pressure sensor, and the signal output from the flow sensor, to generate the supplementary surge control signal and the performance control signal.

4. The compressor control system of claim 3, wherein the ASV controller comprises:

a pressure control signal generator programmed to receive the signal output from the pressure sensor to generate a pressure control signal;

a surge signal generator programmed to receive the at least one of the signal output from the pressure sensor and the signal output from the flow sensor to generate the surge control signal; and a first selector programmed to output one of the pressure control signal and the surge control signal, the first selector comprising a minimum value selector selecting a minimum value from among the pressure control signal and the surge control sigma.

5. The compressor control system of claim 4, wherein the first selector is programmed to output the pressure control signal until the operating point of the compressor reaches the surge control line and output the surge control signal based on the operating point of the compressor reaching the supplementary surge control line.

6. The compressor control system of claim 4, wherein opening of the ASV is adjusted based on the pressure control signal, and the ASV is completely opened by the surge control signal.

7. The compressor control system of claim 3, wherein the IGV controller comprises:

a performance controller programmed to receive at least one of the signal output from the pressure sensor and the signal output from the current sensor to generate the performance control signal;

a supplementary surge signal generator programmed to receive at least one of the signal output from the flow sensor and the signal output from the pressure sensor to generate the supplementary surge control signal; and a second selector programmed to select and output one of the performance control signal and the supplementary surge control signal, the second selector comprising a maximum value selector selecting a maximum value from among the performance control signal and the supplementary surge control signal.

8. The compressor control system of claim 7, wherein the performance controller comprises:

a first opening controller programmed to receive the signal output from the pressure sensor to generate a first opening signal for opening the inlet through the IGV;

a second opening controller programmed to receive the signal output from the current sensor to generate a second opening signal for opening the inlet through the IGV; and a third selector programmed to select and output one of the first opening signal and the second opening signal as the performance control signal.

9. A compressor control method comprising:

generating a performance control signal to control an inlet guide vane (IGV) to adjust opening of an inlet of a compressor compressing a fluid in a performance mode until an operating point of the compressor reaching a surge control line, the performance control signal controlling; the IGV to adjust the opening of the inlet at a first rate;

generating a surge control signal to control an anti-surge valve (ASV) connected to an outlet of the compressor to prevent a surge in the compressor based on the operating point of the compressor reaching the surge control line; and generating a supplementary surge control signal to control the IGV in an anti-surge mode based on the operating point of the compressor reaching a supplementary surge control line set between the surge control line and a surge line where the compressor generates a surge the supplementary surge control signal controlling the IGV to adjust the opening of the inlet at a second rate lower than the first rate.

10. The compressor control method of claim 9, further comprising detecting the operating point of the compressor from at least one of a signal output from a pressure sensor configured to detect a fluid pressure at the outlet of the compressor, a signal output from a flow sensor configured to detect a fluid flow at the outlet of the compressor, and a signal output from a current sensor configured detect a current change in a motor driving the compressor.

11. The compressor control method of claim 10, further comprising, in the generating the performance control signal to control the IGV generating a pressure control signal for adjusting opening of the ASV from the signal output from the pressure sensor until the operating point of the compressor reaches the surge control line.

12. The compressor control method of claim 10, wherein the performance control signal to control the ICV is generated based on at least one of the signal output from the pressure sensor and the signal output from the current sensor.

13. The compressor control method of claim 10, wherein the surge control signal to control the ASV is generated based on at least one of the signal output from the pressure sensor and the signal output from the flow sensor.

14. The compressor control method of claim 10, wherein the performance control signal to control the IGV is generated based on at least one of the signal output from the pressure sensor and the signal output from the current sensor, and wherein the supplementary surge control signal to control the IGV in the anti-surge control mode is generated based on at least one of the signal output from the flow sensor and the signal output from the pressure sensor.

15. The compressor control method of claim 10, wherein the generating the performance control signal to control the IGV comprises:

generating a first opening signal for opening the inlet through the IGV based on a signal of the pressure sensor;

generating a second opening signal for opening the inlet through the IGV based on receiving the signal output from the current sensor; and selecting and outputting one of the first opening signal and the second opening signal as the performance control signal, wherein the selecting comprises selecting, by a maximum value selector a maximum value from among the performance control signal and the supplementary surge control signal.

* * * * *